United States Patent [19]

Brady

[11] 3,985,364

[45] Oct. 12, 1976

[54] GOLF TRAINING DEVICE

[76] Inventor: Joseph P. Brady, 10 Hillcrest Lane, Gallipolis, Ohio 45631

[22] Filed: May 12, 1975

[21] Appl. No.: 576,549

[52] U.S. Cl. ..... 273/183 B; 46/DIG. 1

[51] Int. Cl.[2] ..... A63B 69/36

[58] Field of Search ..... 273/183, 189, 54 B, 273/26 C; 46/DIG. 1

[56] References Cited

UNITED STATES PATENTS

| | | | |
|---|---|---|---|
| 3,188,090 | 6/1965 | Job | 273/189 R |
| 3,677,551 | 7/1972 | Schaus | 273/183 B |
| 3,680,869 | 8/1972 | Brady | 273/183 B |
| 3,804,420 | 4/1974 | Boyd | 273/189 R |
| 3,847,110 | 11/1974 | Inoue | 46/DIG. 1 |
| 3,861,688 | 1/1975 | Butler | 273/183 B |

*Primary Examiner*—George J. Marlo
*Attorney, Agent, or Firm*—Harry W. F. Glemser

[57] ABSTRACT

A golf training device to aid golfers in developing a proper swing and to overcome sway, comprising a flexible cord attached at one end to one end of a strip of material, sold under the trademark VELCRO, adapted to be attached to a similar strip of material mounted on the back of a golfer's glove; a strap for connecting the other end of the cord, in the form of a loop, to the corresponding leg of the golfer; and a clamp for adjusting the loop to provide a cord length to suit the height and arm length of the golfer, the two strips of material being of the well known hook and loop fabrics providing interlocking engagement when pressed together and producing an audible signal when separated or pulled apart upon certain arm and body movements of the golfer. When the downswing is started correctly, the VELCRO strips should separate.

10 Claims, 4 Drawing Figures

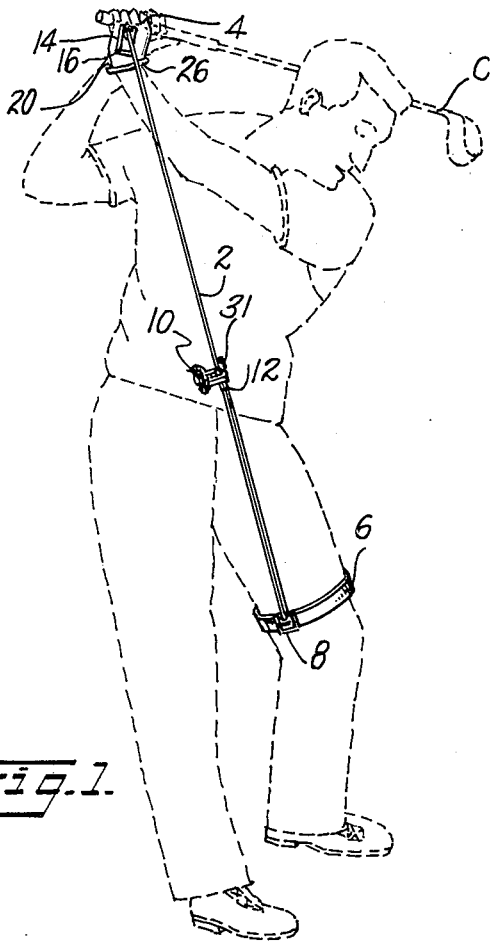
Fig. 1.
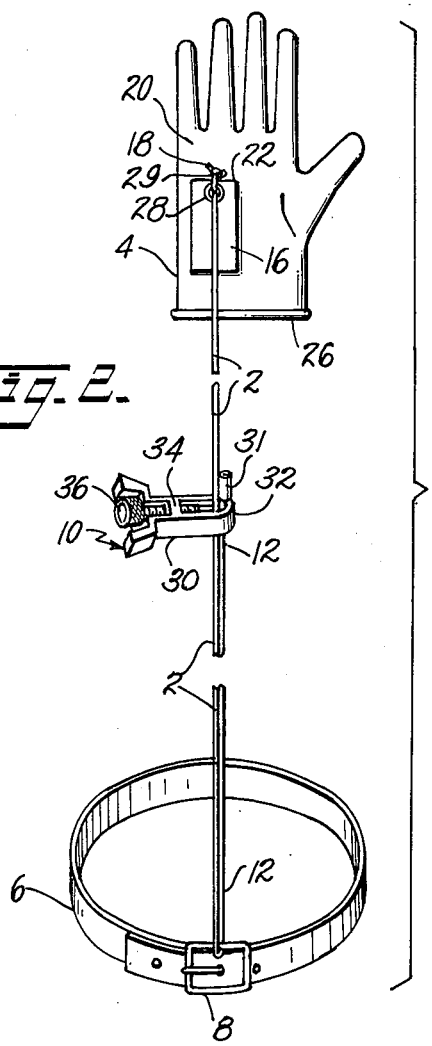
Fig. 2.
Fig. 3.
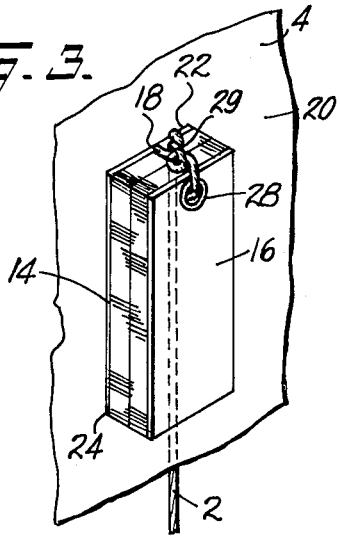
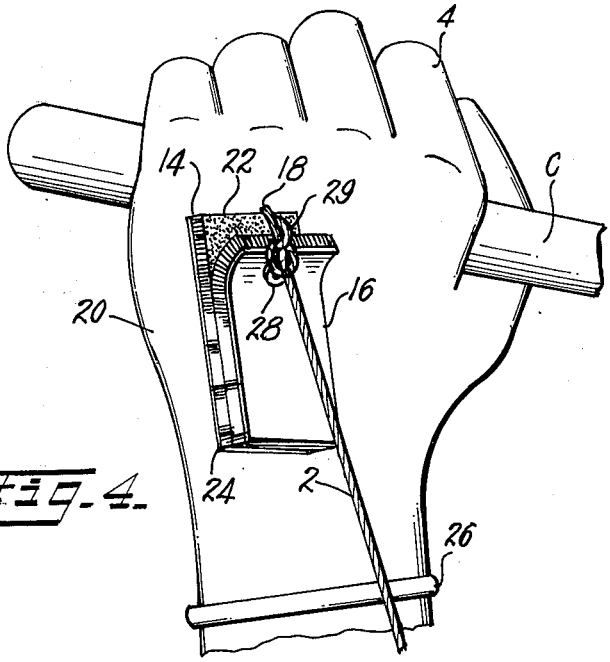
Fig. 4.

GOLF TRAINING DEVICE

FIELD OF THE INVENTION

The present invention relates to an improved golf practice training device or aid, and more particularly to a simplified and improved device to be used by golfers to teach themselves to pivot and avoid body sway during an upswing and to shift their weight from one foot to the other just prior to commencing a downswing.

DESCRIPTION OF THE PRIOR ART

Various devices have been heretofore proposed to aid golfers to improve their form, swing, etc. Such devices include mechanical restraining devices, which are awkward to use; elastic devices which tend to impose an unnatural restraining force on the left arm of the golfer; a guide attached to the golfer's waist to guide the right arm, etc.; all of which devices tend to mechanically guide the golfer's swing and body movements; and while they may be more or less effective while worn, they are encumbering during use and not conductive to developing a free, natural swing that can be effortlessly and consistently repeated in play without their use.

The foregoing objections have been obviated by the golf training device disclosed in my U.S. Pat. No. 3,680,869, granted Aug. 1, 1972, and over which the present invention is an improvement.

SUMMARY OF THE INVENTION

The present invention, like that disclosed in my patent, supra, is designed to impose a minimum of physical restraints upon the golfer, and at the same time enable the golfer to develop correct natural movements that will improve his game. More specifically, the present invention comprises a length of non-stretchable cord, such as NYLON, one end of which is threaded through the buckle of a strap to be fastened around the golfer's left leg above the knee, in the case of a right-handed golfer. The cord is arranged to form a loop, and the free end of the loop is adjustably fastened by a clamp to the cord at a proper point to suit the height and arm length of the particular golfer, as will be explained more fully hereinafter.

A strip of VELCRO is sewn or adhesively secured to the back of a glove worn on the left hand by a right-handed golfer, and vice versa. The VELCRO strip preferably extends from about the knuckle end of the third and fourth fingers to approximately the wrist of the glove. A second strip of VELCRO is tied at one end thereof to the other end of the cord and the two strips are pressed together in the usual manner to make them adhere to each other, with the end of the strip to which the cord is attached positioned nearest to the finger knuckles. In use, the adjustment of the cord length is such that the VELCRO strips start to separate at the time that the golfer reaches the top of his backswing, thereby producing an audible signal. The audible signal warns the golfer that he has raised his arms high enough and that he should commence the downswing. If the practice downswing is correctly executed with the shifting of weight from one foot to the other, the VELCRO strips will completely separate, producing another audible signal; otherwise, they will not separate, indicating to the golfer that he has not performed a correct downswing. The VELCRO strips can be pressed together again and the practice swing repeated as often as desired.

The principal object of the invention is to provide a simple golf practice or training device that will aid a golfer to develop a natural swing and body motion that can be effortlessly repeated during actual play without the use of the training aid.

A more specific object is to provide a device that will enable a golfer to practice a backswing without body sway, and to perform a downswing with proper weight shifting.

Another object is to provide a golf training device that can be used by either lefthanded or righthanded golfers, and which can be adjusted for use by all golfers regardless of their height and arm length.

Another object is to provide a golf training device that can be adjusted by the golfer himself to fit his own particular physical characteristics, and which can be used by the golfer to teach himself to overcome faults in swing and body motion.

A further object is to provide a golf training device that will audibly warn the golfer when he has raised his arms high enough in a backswing, and also produce an audible warning signal if he has correctly shifted his weight during the ensuing downswing.

A still further object is to provide a golf training aid that will teach a golfer to avoid side sway during a backswing.

Still another object is to provide a golf training device that can be cheaply and inexpensively made.

Other objects and advantages of the invention will be apparent from the following description taken in conjunction with the accompanying drawings.

DESCRIPTION OF THE DRAWINGS

FIG. 1 is a perspective view illustrating the present golf training aid as it would normally be used by a right-handed golfer during practice.

FIG. 2 is a schematic view illustrating the components of the golf training device.

FIG. 3 is an enlarged fragmentary perspective view, particularly showing the manner in which the cord is positioned between the VELCRO strips during adjustment of the cord length.

FIG. 4 is an enlarged fragmentary perspective view illustrating the VELCRO strips partially separated.

DESCRIPTION OF THE PREFERRED EMBODIMENT

The present golf training device consists of a few very simple parts, namely: a length of flexible, non-stretchable material such as NYLON cord 2; a glove 4 to be worn by the golfer; a leg strap 6 having a buckle 8 through which one end of the cord 2 is threaded and looped; an adjustable clamp 10 for securing the looped end 12 of the cord in proper adjusted position; and two matching strips of VELCRO 14 and 16, the strip 14 being attached to the glove 4 and the strip 16 being connected to the other end 18 of the cord 2, each VELCRO strip being about ¾ of an inch (1.90 cm.) wide and about 1¾ inches (4.44 cm.) long, although it is to be understood that strips of any other suitable size can be used.

The VELCRO strip 14 is stitched or adhesively secured to the back portion 20 of the glove 4, with an end 22 of the strip 14 secured to the glove adjacent the knuckles of the third and fourth fingers of the hand, the other end 24 of said strip extending to approximately the wrist band 26 of the glove 4. The VELCRO strip 16 is tied to the end 18 of the cord 2 by first passing the cord through an eyelet 28 mounted in the strip and then tying a knot 29. Upon pressing the strips 14 and 16 together, they will adhere to each other, as is well understood, and in this manner attach the free end 18 of the cord 2 to the glove 4. The other end 12 of the cord 2 can be knotted, or may have a piece of plastic 31 secured thereto, to prevent it from slipping out of the clamp 10.

As is best shown in FIG. 2, the clamp 10 comprises a body 30 including a U-shaped portion 32 and a threaded transverse portion 34 in which a clamp screw 36 is mounted. The cord 2 is threaded through the U-shaped portion 32 of the clamp 10 and is passed through the buckle 8 of the leg strap 6; and the end 12 of the cord 2 is passed through the U-shaped portion 32 of the clamp 10. Tightening of the screw 36 will hold the end 12 of the cord 2 in any desired position, so that the length of the cord between the glove 4 and the leg strap 6 can be adjusted to the desired length for the golfer being fitted with the same.

In using the above described training aid, glove 4 is worn on the left hand of the golfer (in the case of a righthanded golfer) with the VELCRO strip 14 at the back of the hand. The strap 6 is placed around the corresponding (left) leg of the golfer just above the knee, the buckle 8 being on the front side of the leg and with the free end of the strap 6 directed toward the inner side of the leg. The cord 2 is thus suspended between the buckle 8 and the glove 4. The upper end of the cord 2 is detachably connected to the VELCRO strip 14 by the VELCRO strip 16, while the lower end of the cord 2 passes freely through the buckle 8. The free end 12 of the cord 2 passes through the clamp 10 and can be secured in place by tightening the screw 36. The effective length of the cord 2 between the VELCRO strip 16 and the buckle 8 will vary according to the height and arm length of the golfer using the device, so that proper individual adjustment can be readily obtained by the presence of the slack in the loop between the buckle 8 and the clamp 10.

In order to effect proper adjustment of the present device, the strap 6 is applied to the leg, as described above, and the two VELCRO strips 14 and 16 are pressed together with the cord extending between the confronting faces of the strip, as shown in FIG. 3, to properly hold it in place for better stability and decrease the chance of the strips separating. The adjustable clamp 10 is initially secured to the cord 2 in such a manner that the length of the cord between the buckle 8 and the strip 14 is shorter than required and so that the cord can slide through the clamp 10 without excessive binding. In other words, a slight drag is applied to the cord 2 so that the clamp 10 will not move downwardly without an upward pull being exerted on the cord 2. The golfer then takes a normal backswing, stopping at the top of the swing. This will slide the clamp 10 downwardly along the cord 2 to a distance corresponding to the backswing. The screw 36 is then tightened, thereby completing the adjustment of the cord to suit the backswing of the golfer. The VELCRO strips 14 and 16 are then separated to release the cord 2.

In order to use the device in practice, the golfer positions the VELCRO strips 14 and 16 together. Whereupon, as the golfer raises the club C and makes a proper backswing, the strips will start to separate at the time that the arms of the golfer reach the top position for the backswing. The separation of the strips 14 and 16 will produce a tearing sound, serving as an audible signal to the golfer to indicate that he has reached the top of the backswing stroke.

When the golfer initiates the downswing and shifts his weight from the right to the left foot, the left knee is moved back toward its initial position at the time the golfer first addressed the ball. This causes further and complete separation of the strips 14 and 16, which will also produce a signal, audible to the golfer. Such complete separation is effected because the distance from the glove 4 to the leg strap 6 becomes greater than the actual distance between these points at the time that the cord 2 was initially adjusted. When, however, the downswing is not initiated with the proper weight shift, the further separation of the strips 14 and 16 does not occur, and the golfer does not further separate the strips to produce an additional audible signal, thereby indicating that he failed to make the proper weight shift during the downswing. The above-described procedure can be repeated by again fastening the strips 14 and 16 together and again performing the backswing and downswing strokes until the golfer learns to automatically position his arms correctly for the backswing and to shift weight from the right foot to the left foot during the down stroke.

It will be apparent that "standard" lengths of the flexible member or cord 2 can be determined for use by golfers of a given height and given arm length, so that the clamp 10 and the adjustment provided thereby can be omitted; and that in such case, one end of the cord will be fastened to the leg strap 6 and a piece of VELCRO fastened to the opposite end of the cord. This will enable the use of a shorter cord and also eliminate the need for adjustment in the case of a golfer obtaining the correct cord length to start with. Some leeway can be introduced in a standard cord set by making the strip 16 adjustably clampable on the cord 2.

Thus, it will be seen that the present golf practice device can be used by any golfer to develop correct body shifting and a correct downswing, and can be also used to train the golfer to avoid body sway during either upswing or downswing strokes.

It will be understood that the training device disclosed herein can be used equally well by righthanded or lefthanded golfers simply by attaching a piece of VELCRO to the back of either the left hand or right hand glove. Correspondingly, the strap 6 can be attached to the right instead of the left leg of the golfer.

It is to be understood that the word "left" as used herein is to be construed as including the right hand and right leg; and that the word "left" can be construed to mean "right."

It will be further understood that various changes may be made in the arrangement, design and construction of the parts described above without departing from the principles of the invention or the scope of the annexed claims.

I claim:

1. A golf training device, comprising: a glove having fingers, a back and a wrist portion; a first strip of material attached to the back of said glove; a length of nonstretchable cord; and a second strip of material separably attachable to said first strip of material secured to one end of said cord, said second strip of material being attachable in confronting relation to said first strip of material, the structural characteristics of said separably attachable first and second strips corresponding to those of the interlocking fabric material VELCRO so that said strips will adhere to each other when pressed together, and said strips will produce a tearing sound as an audible signal to the golfer when a predetermined force is applied to said cord and causes said strips to separate while said golfer is training.

2. A golf training device as claimed in claim 1, wherein the first strip of material is attached to the glove with one end of said first strip located adjacent the end of the third and fourth fingers of the glove with the remainder of said first strip extending lengthwise toward the wrist portion of the glove.

3. A golf training device as claimed in claim 2, wherein the end of the second strip of material to which the cord is secured is positioned adjacent said one end of said first strip of material.

4. A golf training device, comprising: a member including a portion to be worn adjacent the back of the wrist of one hand of a golfer; a first strip of material attached to said portion of said member; a length of cord; a second strip of material secured at one of its ends to one end of said cord and being detachably connectable with said first strip of material; a strap to be secured to the leg of the golfer above the knee, the other end of said cord being connected with said strap so as to form a loop; and means spaced from said strap for adjusting the length of said loop.

5. A golf training device as claimed in claim 4, wherein the member to be worn by the golfer is a glove having fingers and a back portion.

6. A golf training device as claimed in claim 5, wherein the first strip of material is attached to the back of the glove.

7. A golf training device as claimed in claim 6, wherein one end of said first strip is located adjacent the end of the third and fourth fingers of the glove.

8. A golf training device as claimed in claim 4, wherein the second strip of material is tied to the cord.

9. A golf training device as claimed in claim 8, wherein an eyelet is mounted in said second strip of material adjacent one end thereof and the tied end of the cord extends through the eyelet.

10. A golf training device as claimed in claim 4, wherein the means for adjusting the length of the loop is a clamp that is movable along the cord and has one end of the cord attached thereto.

* * * * *